US008616339B2

(12) United States Patent
Endo

(10) Patent No.: US 8,616,339 B2
(45) Date of Patent: Dec. 31, 2013

(54) ELEVATOR CONTROL DEVICE

(75) Inventor: Takamasa Endo, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 459 days.

(21) Appl. No.: 13/125,636

(22) PCT Filed: Dec. 8, 2008

(86) PCT No.: PCT/JP2008/072238

§ 371 (c)(1),
(2), (4) Date: Apr. 22, 2011

(87) PCT Pub. No.: WO2010/067406

PCT Pub. Date: Jun. 17, 2010

(65) Prior Publication Data

US 2011/0203879 A1 Aug. 25, 2011

(51) Int. Cl.
*B66B 1/20* (2006.01)

(52) U.S. Cl.
USPC ..... 187/384; 187/391

(58) Field of Classification Search
USPC ..... 187/247, 313, 314, 316, 317, 380–393, 187/396
See application file for complete search history.

(56) References Cited

U.S. PATENT DOCUMENTS 5,979,607 A * 11/1999 Allen ..... 187/390
7,461,723 B2 * 12/2008 Kawai ..... 187/313
7,849,973 B2 * 12/2010 Hikita et al. ..... 187/384
7,938,232 B2 * 5/2011 Hikita et al. ..... 187/384
7,963,372 B2 * 6/2011 Hikita ..... 187/387
8,109,368 B2 * 2/2012 Manabe ..... 187/384
8,113,320 B2 * 2/2012 Kawai et al. ..... 187/384

(Continued)

FOREIGN PATENT DOCUMENTS

JP 55 67054 5/1980
JP 5 147849 6/1993

(Continued)

OTHER PUBLICATIONS

International Search Report issued Sep. 8, 2009 in PCT/JP08/72238 filed Dec. 8, 2008.

(Continued)

*Primary Examiner* — Anthony Salata
(74) *Attorney, Agent, or Firm* — Oblon, Spivak, McClelland, Maier & Neustadt, L.L.P.

(57) ABSTRACT

There is provided an elevator control device that performs fire emergency operation based on a contact signal sent from a fire detector having a contact B, wherein even in the case where, for example, when the elevator is being installed, the contact signal sent from the fire detector cannot be used, the normal operation of elevator can be performed. For this purpose, the elevator control device includes an operation selection control section that causes the normal operation to be performed when a contact signal sent from the fire detector is received, and causes the fire emergency operation to be performed when the contact signal sent from the fire detector is cut off, and a function judgment section for judging, based on predetermined conditions, whether or not a fire emergency operation function of the elevator is valid. When it is judged, by the function judgment section, that the fire emergency operation function of the elevator is invalid, the operation selection control section causes normal operation to be performed regardless of the presence or absence of the contact signal sent from the fire detector.

4 Claims, 4 Drawing Sheets

(56) References Cited

U.S. PATENT DOCUMENTS

| | | | | |
|---|---|---|---|---|
| 8,230,980 | B2 * | 7/2012 | Mason | 187/388 |
| 8,251,185 | B2 * | 8/2012 | Manabe | 187/384 |
| 8,281,901 | B2 * | 10/2012 | Kawai et al. | 187/392 |
| 2007/0278044 | A1 * | 12/2007 | Hikita et al. | 187/247 |
| 2009/0038892 | A1 * | 2/2009 | Kawai et al. | 187/387 |

FOREIGN PATENT DOCUMENTS

| | | |
|---|---|---|
| JP | 2003 30173 | 1/2000 |
| JP | 2003 335475 | 11/2003 |
| JP | 2005-22799 | 1/2005 |
| JP | 2006-344191 | 12/2006 |
| JP | 2007-153597 | 6/2007 |

OTHER PUBLICATIONS

English translation of the International Preliminary Report on Patentability and Written Opinion of the International Searching Authority issued Jul. 14, 2011, in PCT/JP2008/072238.

Japanese Office Action issued Mar. 19, 2013, in Japan Patent Application No. 2010-541900 (with English translation).

* cited by examiner

ELEVATOR CONTROL DEVICE

TECHNICAL FIELD

The present invention relates to an elevator control device provided with a fire emergency operation function.

BACKGROUND ART

There has conventionally been known an elevator such that fire emergency operation is performed based on a detection signal sent from a fire detector.

In this fire emergency operation, based on a detection signal sent from the fire detector, the floor on which fire has occurred is identified, and control is carried out to safely evacuate passengers avoiding the identified fire occurrence floor (for example, refer to Patent Document 1).

Patent Document 1: Japanese Patent Laid-Open No. 5-147849

DISCLOSURE OF THE INVENTION

Problems to be Solved by the Invention

For the conventional elevator including the elevator described in Patent Document 1, fire emergency operation has generally been performed based on the detection result of a fire detector having a contact A. The contact A is a normal open type contact that is open at the normal time. That is, the fire detector having the contact A means a detector of a type such that the contact is open at the normal time, and when the occurrence of fire is detected, the contact is closed and a detection signal (contact signal) is generated.

In the case where the fire detector having the contact A is provided in a building, the elevator control device has an advantage that the normal operation can be performed even if the detection signal from the fire detector is not present. On the other hand, the control device configured as describe above has posed a problem that if a signal line for transmitting the detection signal, which is sent from the fire detector, to the control device is broken, the detection signal is not received by the control device when fire occurs actually, so that the elevator cannot be transferred to the fire emergency operation.

To solve this problem, in recent years, attaching great importance to the concept of failsafe, there has been realized an elevator such that the fire detector having a contact B is installed to the building, and the contact signal sent from the fire detector is utilized for the control of elevator. The contact B is a normal closed type contact that is closed at the normal time. That is, the fire detector having the contact B means a detector of a type such that the contact is closed to generate the contact signal at the normal time, and when the occurrence of fire is detected, the contact is opened and the contact signal is cut off.

In the case where the fire detector having the contact B is provided in the building, for the elevator control device, if the signal line is broken, the elevator is transferred to the fire emergency operation. That is, control giving the highest priority to safety is carried out.

On the other hand, the control device configured as described above has posed a problem that the normal operation cannot be performed unless the contact signal is received from the fire detector. For example, when the elevator is being installed, if the contact signal of fire detector is not prepared on the building side, the normal operation (in such a case, the installation mode operation) of elevator cannot be performed.

Therefore, until the fire detector has been prepared on the building side, the elevator detects the occurrence of fire mistakenly, so that the installation work and the like using the elevator have been unable to be performed.

The present invention has been made to solve problems as described above and the object of the invention is to provide an elevator control device that performs fire emergency operation based on a contact signal sent from a fire detector having a contact B, and can perform the normal operation of elevator even in the case where, for example, when the elevator is being installed, the contact signal sent from the fire detector cannot be used.

Means for Solving the Problems

An elevator control device of the present invention is an elevator control device which performs predetermined fire emergency operation based on a contact signal sent from a fire detector. The elevator control device comprises a normal operation control section for controlling normal operation of an elevator, a fire emergency operation control section for controlling the fire emergency operation, an operation selection control section which causes the normal operation control section to perform the normal operation when a contact signal sent from the fire detector is received, and causes the fire emergency operation control section to perform the fire emergency operation when the contact signal sent from the fire detector is cut off, and a function judgment section for judging, based on predetermined conditions, whether or not a fire emergency operation function of the elevator is valid. When it is judged, by the function judgment section, that the fire emergency operation function of the elevator is invalid, the operation selection control section causes the normal operation control section to perform the normal operation regardless of the presence or absence of the contact signal sent from the fire detector.

Effect of the Invention

According to the present invention, in the elevator control device that performs fire emergency operation based on the contact signal sent from the fire detector having the contact B, even in the case where, for example, when the elevator is being installed, the contact signal sent from the fire detector cannot be used, the normal operation of elevator can be performed.

BRIEF OF DESCRIPTION OF THE DRAWINGS

DESCRIPTION OF SYMBOLS

1 car,

2 counterweight,

3 main rope,
4 traction machine,
5 control panel,
6 fire detector,
7 hall,
8 hall call registration device,
8*a* hall button,
9 traveling cable,
10 CPU,
11 RAM,
12 RSW,
13 display,
14 fire emergency operation control section,
15 normal operation control section,
16 sensor input section,
17 sensor judgment section,
18 function judgment section,
19 operation selection control section,
20 display control section

BEST MODE FOR CARRYING OUT THE INVENTION

The present invention will be described in more detail with reference to the accompanying drawings. Incidentally, in each of the drawings, like numerals refer to like or similar parts and redundant descriptions of these parts are appropriately simplified or omitted.

First Embodiment

Figure 1:
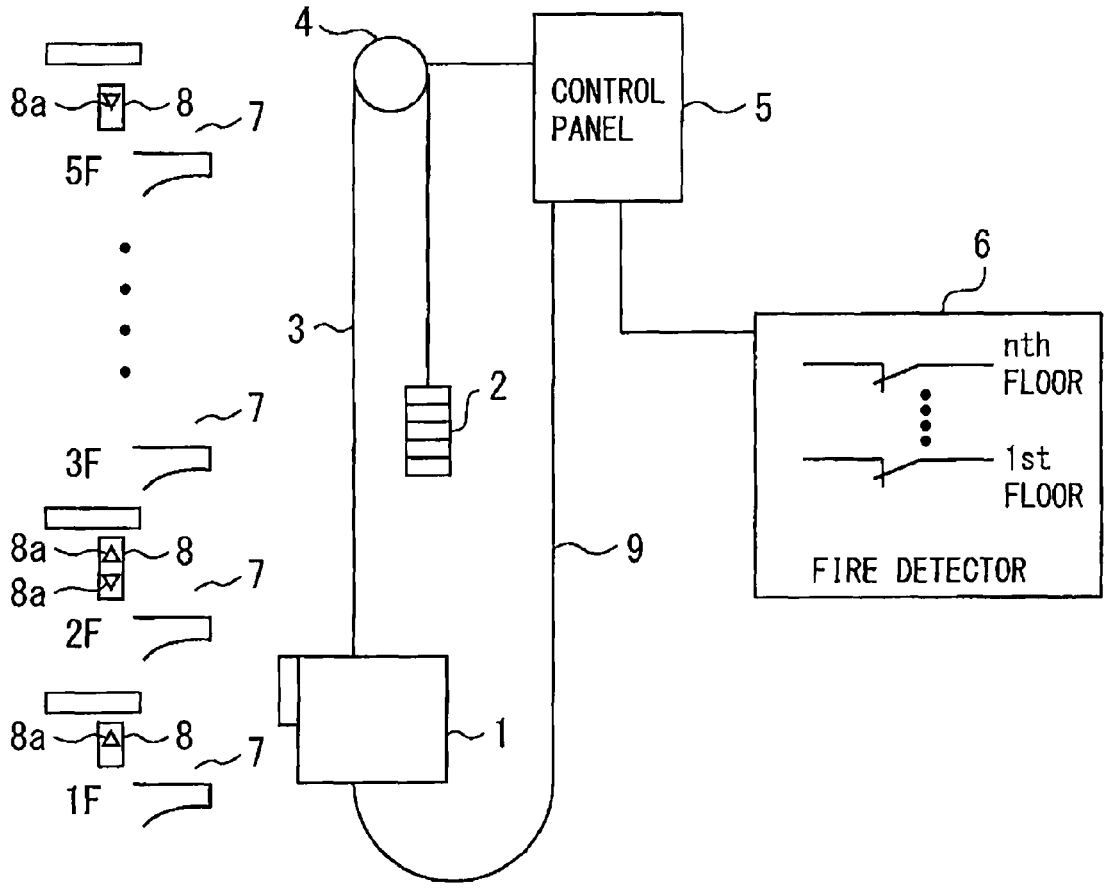
FIG. 1 is a schematic configuration view showing a state in which an elevator system equipped with a control device in a first embodiment according to the present invention has been installed.

FIG. 1 is a schematic configuration view showing a state in which an elevator system equipped with a control device in a first embodiment according to the present invention has been installed. In FIG. 1, reference numeral 1 denotes a car moving up and down in an elevator shaft, 2 denotes a counterweight moving up and down in the shaft in the direction reverse to the moving direction of the car 1, and 3 denotes a main rope suspending the car 1 and the counterweight 2 in a well bucket manner. A part of the main rope 3 is wound around a traction machine 4 provided, for example, at a top portion of the shaft, and the main rope 3 moves in association with the turn of (a driving sheave of) the traction machine 4. That is, by the driving of the traction machine 4, the car 1 (and the counterweight 2) moves in the shaft via the movement of the main rope 3.

Reference numeral 5 denotes a control panel that conducts the operation control of the entire of elevator, for example, the control of the traction machine 4. The control panel 5 is provided with a fire emergency operation function. That is, the control panel 5 has a function of carrying out predetermined fire emergency operation based on a contact signal sent from a fire detector 6 provided on each floor of a building. Specifically, first, the control panel 5 identifies a floor on which fire has occurred based on a contact signal sent from the fire detector 6. After the fire occurrence floor has been identified, the control panel 5 carries out control for safely evacuating passengers avoiding the identified fire occurrence floor.

The fire detector 6 is configured by a detector having a contact B. That is, for the fire detector 6, the contact thereof is closed and a contact signal is generated at the normal time, and when the occurrence of fire is detected, the contact is opened and the contact signal is cut off.

Also, in FIG. 1, reference numeral 7 denotes an elevator hall, 8 denotes a hall call registration device provided in the hall 7, 8*a* denotes a hall button provided on the hall call registration device 8, and 9 denotes a traveling cable that connects the car 1 to the control panel 5.

Figure 2:
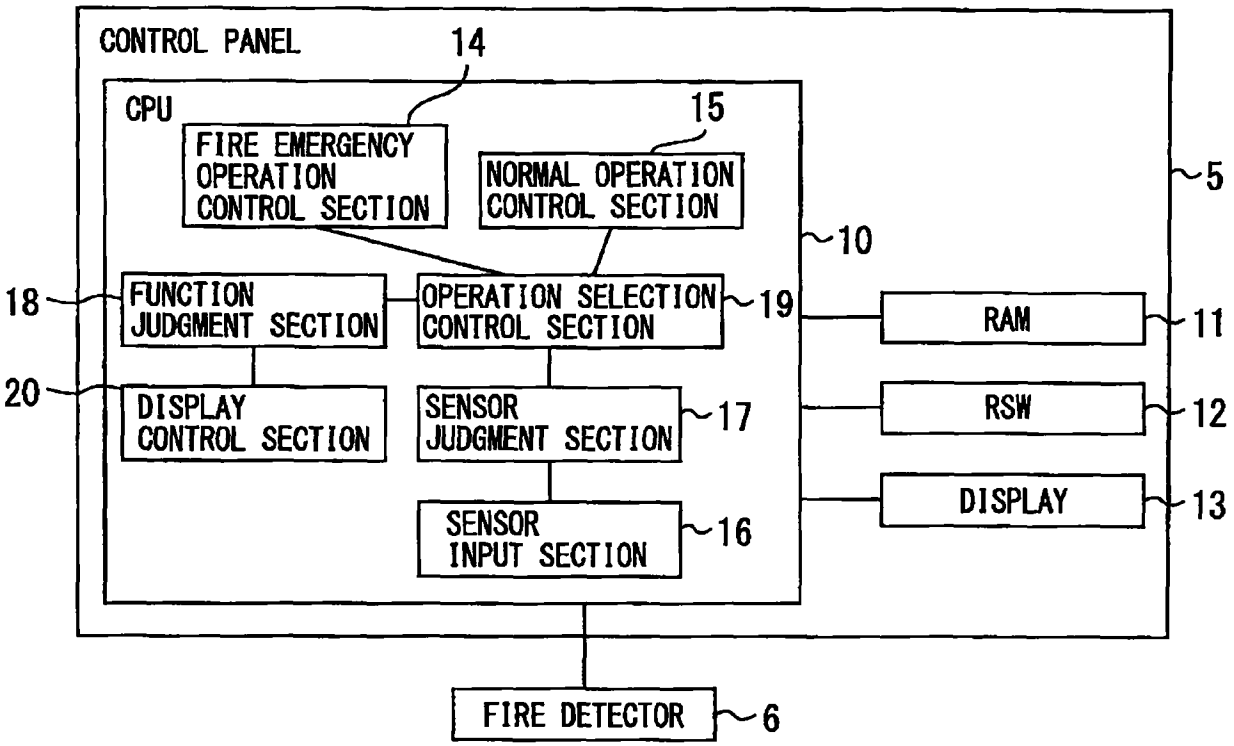
FIG. 2 is a block diagram showing the elevator control device in the first embodiment according to the present invention.
Figure 3:
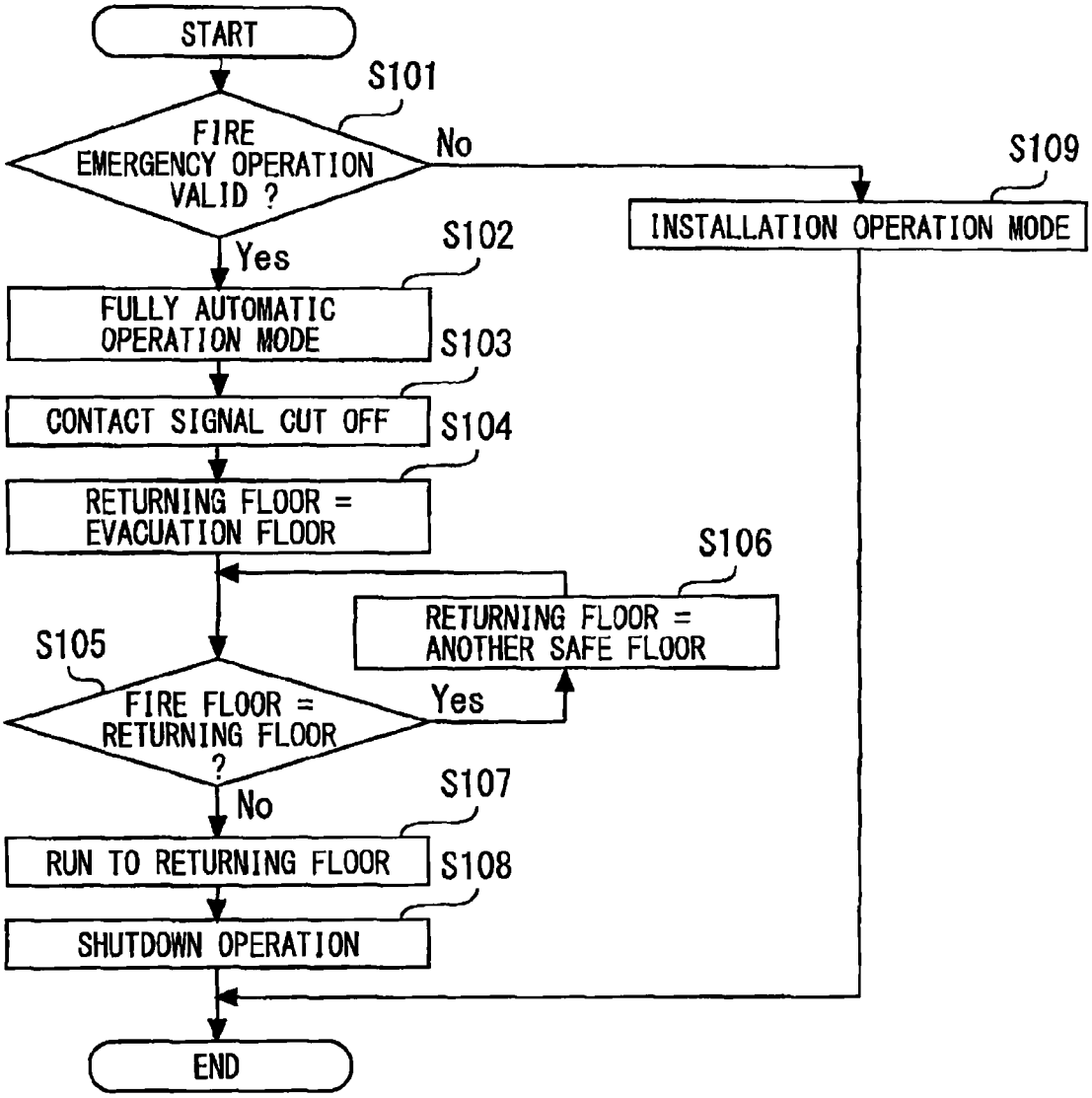
FIG. 3 is a flowchart showing the operation of the elevator control device in the first embodiment according to the present invention.
Figure 4:
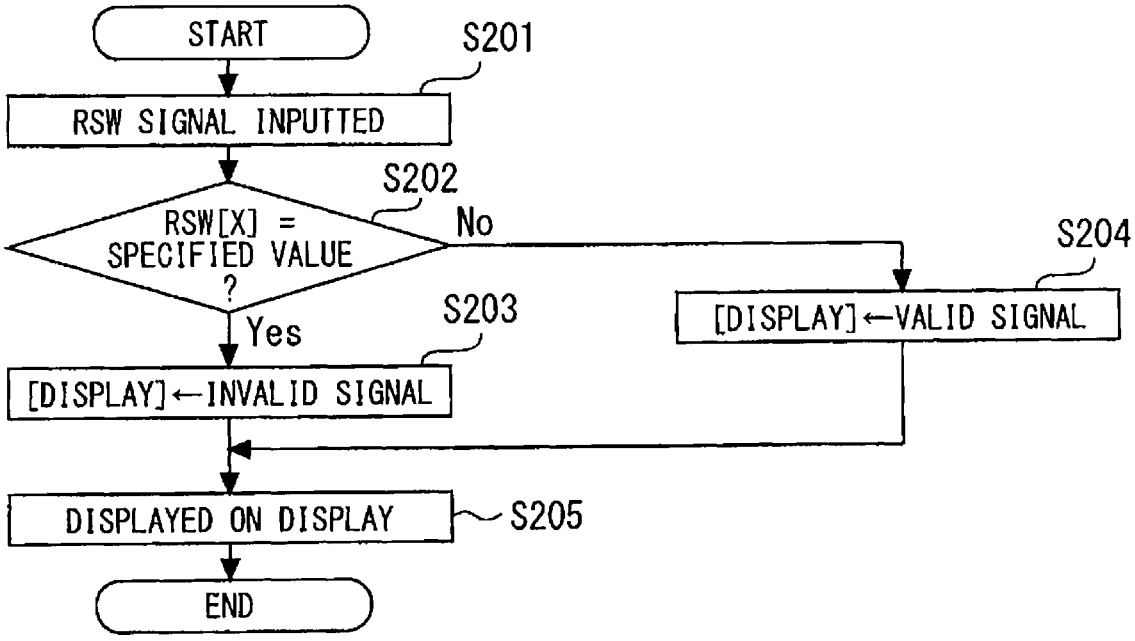
FIG. 4 is a flowchart showing another operation of the elevator control device in the first embodiment according to the present invention.

Next, with reference to FIGS. 2 to 4, the configuration (function) and operation of the control panel 5 are specifically explained. FIG. 2 is a block diagram showing the elevator control device in the first embodiment according to the present invention, FIG. 3 is a flowchart showing the operation of the elevator control device in the first embodiment according to the present invention, and FIG. 4 is a flowchart showing another operation of the elevator control device in the first embodiment according to the present invention.

In FIG. 2, the essential portion of the control panel 5 is configured by a CPU 10, a RAM 11, an RSW 12, and a display 13. Also, the CPU 10 includes various function sections such as a fire emergency operation control section 14, a normal operation control section 15, a sensor input section 16, a sensor judgment section 17, a function judgment section 18, an operation selection control section 19, and a display control section 20.

The fire emergency operation control section 14 has a function of properly controlling the fire emergency operation based on various pieces of input information when fire occurs. The specific operation thereof at the time of fire emergency operation is described later.

The normal operation control section 15 has a function of properly controlling normal operation of elevator. The normal operation means operations other than the fire emergency operation of operations required for the elevator. For example, in addition to the common operation (fully automatic operation) for carrying passengers to a destination floor based on a hall call, car call, and the like, maintenance operation performed at the time of elevator maintenance and installation operation performed at the time of elevator installation are also controlled by the normal operation control section 15.

The sensor input section 16 has a function of receiving a contact signal, which is sent from each fire detector 6 provided in the building, into the control panel 5. Specifically, the sensor input section 16 stores information on the presence and absence of a contact signal, which is sent from each fire detector 6 (contact information), in the RAM 11.

The sensor judgment section 17 has a function of judging the presence and absence of fire occurrence and the fire situation in the hall 7 of the evacuation floor based on the contact information stored in the RAM 11.

The function judgment section 18 judges whether or not the fire emergency operation function of elevator is valid based on predetermined conditions. For example, the RSW 12 consisting of a special-purpose switch or the like is provided on the control panel 5 in advance, and when the value of the RSW 12 agrees with a predetermined specified value preset in the RAM 11, it is judged that the fire emergency operation function is invalid.

Also, the operation selection control section 19 has a function of selecting either the normal operation or the fire emergency operation as the elevator operation based on the judgment results of the sensor judgment section 17 and the function judgment section 18. Specifically, if it is judged, by the function judgment section 18, that the fire emergency operation function of elevator is valid, when the contact signal sent from any fire detector 6 is cut off, the operation selection control section 19 sends an operation command and a returning floor command to the fire emergency operation control section 14 to perform the fire emergency operation. Also, in the case where the contact signals sent from all the fire detectors 6 are received when the fire emergency operation function is valid, the operation selection control section 19 causes the normal operation control section 15 to perform normal operation.

On the other hand, if it is judged, by the function judgment section 18, that the fire emergency operation function of elevator is invalid, the operation selection control section 19 causes the normal operation control section 15 to perform the normal operation regardless of the presence or absence of the contact signal sent from each fire detector 6.

The display control section 20 has a function of controlling the display content of the display 13. Specifically, if it is judged, by the function judgment section 18, that the fire emergency operation function of elevator is invalid, the display control section 20 causes the display 13 to display this fact, and gives notice to the outside that the fire emergency operation function of elevator is invalid.

Next, the specific operation of the control panel 5 is explained with reference to FIGS. 3 and 4.

In FIG. 3, in the control panel 5, the function judgment section 18 judges whether or not the fire emergency operation function is valid based on the value of the RSW 12 (S101). If it is judged, by the function judgment section 18, that the fire emergency operation function is valid, the operation selection control section 19 sends an operation mode signal, which causes the fully automatic operation to be performed, to the normal operation control section 15 (S102).

Also, in the control panel 5, the contact information sent from each fire detector 6 is stored in the RAM 11 by the sensor input section 16, and the contact information is updated in succession. If the contact signal sent from any fire detector 6 is cut off, the occurrence of fire is detected by the sensor judgment section 17, and the fire occurrence floor (fire floor) is identified (S103).

The sensor judgment section 17 having identified the fire floor first sets the evacuation floor stored in the RAM 11 in advance to the returning floor in the fire emergency operation (S104). Then, it is judged whether or not the returning floor set in S104 is the fire floor identified in S103, and if not, the sensor judgment section 17 causes the operation selection control section 19 to send an operation command to perform the fire emergency operation (S105). If the returning floor is the fire floor in S105, the sensor judgment section 17 re-set the returning floor to another safe floor (S106) to make judgment of S105 again.

Then, the fire emergency operation control section 14 runs the car 1 to the returning floor based on the operation command received from the operation selection control section 19, and performs shutdown operation after the passengers are rescued (S107, S108).

On the other hand, if it is judged, by the function judgment section 18 in S101, that the fire emergency operation function is invalid, the operation selection control section 19 sends an operation mode signal, which causes the installation operation to be performed, to the normal operation control section 15 regardless of the presence or absence of the contact signal sent from each fire detector 6 (S109). In such a case, the fire emergency operation is not performed until it is judged, by the function judgment section 18, that the fire emergency operation function is valid.

In the case shown in FIG. 3, when it is judged, by the function judgment section 18, that the fire emergency operation function is invalid, the normal operation control section 15 is not caused to perform fully automatic operation, but is caused to perform installation operation (special operation) in which some functions of fully automatic operation are restricted or changed. That is, in this embodiment, in the case where the fire emergency operation function is set to invalid by the RSW 12, fully automatic operation is not performed. Therefore, due to the fact that fully automatic operation cannot be performed, the installation worker, the maintenance worker, and the like for the elevator can recognized that the fire emergency operation function is set to invalid, so that the RSW 12 can be prevented from being forgotten to return.

Also, in the control panel 5, as shown in FIG. 4, the value of the RSW 12 is stored in the RAM 11 in succession (S201), and this value is judged by the function judgment section 18. Specifically, the function judgment section 18 judges whether or not the value of the RSW 12 agrees with a predetermined specified value preset in the RAM 11, and if the judgment result is Yes, it is judged that the fire emergency operation function is invalid, and if the judgment result is No, it is judged that the fire emergency operation function is valid (S202).

Based on the judgment result of S202, if the fire emergency operation function is invalid, the display control section 20 sends a signal to that effect to the display 13 (S203), and if the fire emergency operation function is valid, the display control section 20 sends a signal to that effect to the display 13 (S204). The display 13 displays the content in accordance with the judgment result of S202 (S205).

According to the first embodiment of the present invention, even in the case where the contact signal sent from the fire detector 6 cannot be used, for example, at the time of elevator installation, the normal operation of elevator can be performed. Therefore, even if the contact signals of some fire detectors 6 are not prepared on the building side, for example, at the building installation time or the building remodeling time, the elevator can be operated arbitrarily. Therefore, for example, an elevator operation confirming test or installation work using the elevator can be carried out on work schedule.

Also, by means of the display of the display 13, the above-described special operation, or the like, the elevator installation worker and the like can recognize that the fire emergency operation function is invalid. Therefore, the elevator can be prevented from being delivered to the user side in the state in which the fire emergency operation function is set invalid.

In the special operation performed by the normal operation control section 15, control is carried out such that a hall call from the hall 7 is registered by an operation, for example, different from the operation performed at the time of fully automatic operation. In such a configuration, the hall call cannot be registered by the normal operation. Therefore, even if the elevator is delivered to the user side in the state in which the fire emergency operation function is set invalid, the forgetting about returning the RSW 12 can be discovered at early time.

The above-described special operation is merely one example, and the control content thereof is not limited to the above-described configuration.

Also, in this embodiment, the configuration for making the fire emergency operation function invalid using S/W has been explained specifically. However, a method for short-circuiting the contact signal using H/W also can achieve the same effect. However, the use of S/W can offer an advantage that the forgetting about returning the short-circuit in the use of H/W can be eliminated and an advantage that excess wiring is not present and therefore the wiring material can be saved.

INDUSTRIAL APPLICABILITY

The elevator control device according to the present invention can be used as an elevator control device that performs fire emergency operation based on a contact signal sent from a fire detector having a contact B.

The invention claimed is:

1. An elevator control device which performs predetermined fire emergency operation based on a contact signal sent from a fire detector, comprising:

a normal operation control section for controlling normal operation of an elevator;

a fire emergency operation control section for controlling the fire emergency operation;

an operation selection control section which causes the normal operation control section to perform the normal operation when a contact signal sent from the fire detector is received, and causes the fire emergency operation control section to perform the fire emergency operation when the contact signal sent from the fire detector is cut off; and a function judgment section for judging, based on predetermined conditions, whether or not a fire emergency operation function of the elevator is valid, wherein when it is judged, by the function judgment section, that the fire emergency operation function of the elevator is invalid, the operation selection control section causes the normal operation control section to perform the normal operation regardless of the presence or absence of the contact signal sent from the fire detector.

2. The elevator control device according to claim 1, wherein when it is judged, by the function judgment section, that the fire emergency operation function of the elevator is invalid, the operation selection control section causes the normal operation control section to perform special operation in which some functions of fully automatic operation are restricted or changed regardless of the presence or absence of the contact signal sent from the fire detector.

3. The elevator control device according to claim 2, wherein the normal operation control section controls the special operation by registering a hall call from a hall by means of an operation different from the operation performed at the time of fully automatic operation.

4. The elevator control device according to claim 1, wherein the control device further comprises a display control section which is configured so that when it is judged, by the function judgment section, that the fire emergency operation function of the elevator is invalid, a predetermined display is caused to display to that effect.

* * * * *